United States Patent [19]

Jensen et al.

[11] Patent Number: 4,732,325

[45] Date of Patent: Mar. 22, 1988

[54] APPARATUS FOR CLEANING SURFACES

[75] Inventors: Erik Jensen, Randers; Oluf Kjær, Rodkjærsbro, both of Denmark

[73] Assignee: Gerni A/S, Randers, Denmark

[21] Appl. No.: 920,088

[22] Filed: Oct. 17, 1986

[30] Foreign Application Priority Data

Aug. 19, 1986 [DK] Denmark ..... 3948/86

[51] Int. Cl.[4] ..... B05B 1/28

[52] U.S. Cl. ..... 239/288; 239/381; 239/451; 239/DIG. 19

[58] Field of Search ..... 239/101, 237, 242, 240, 239/589.1, 380–383, 389, 451, 590.3, 590.5, 600, 103, 104, 288, 263, 263.3, DIG. 19

[56] References Cited

U.S. PATENT DOCUMENTS

| | | | |
|---|---|---|---|
| 1,855,647 | 4/1932 | Pottenger, Jr. | 239/381 X |
| 2,981,284 | 4/1961 | Putnam | 239/DIG. 19 X |
| 3,321,140 | 5/1967 | Parkison et al. | 239/590.3 |
| 3,739,983 | 6/1973 | Jousson | 239/101 |

FOREIGN PATENT DOCUMENTS

| | | | |
|---|---|---|---|
| 3024114C2 | 4/1983 | Fed. Rep. of Germany . | |
| 97333 | 1/1961 | Norway | 239/104 |
| 658129 | 10/1951 | United Kingdom | 239/263.3 |
| 2063714A | 6/1981 | United Kingdom . | |

*Primary Examiner*—Andres Kashnikow
*Assistant Examiner*—Michael J. Forman
*Attorney, Agent, or Firm*—Millen & White

[57] ABSTRACT

An apparatus for cleaning surfaces by means of a jet of cleaning liquid comprises a sluicing pipe with a housing provided with a tiltably arranged nozzle assembly. The latter is adapted to perform oscillations by means of a hydraulic motor mounted in the housing and driven by the cleaning liquid flowing to the nozzle assembly. The nozzle assembly is located within the housing and comprises at its front end a contact surface, by means of which it is capable of tilting on the bearing surface provided with a discharge opening on a discharge member located at the outlet of the housing. The discharge member comprises a central flow channel for the cleaning liquid, and the discharge opening has a sectional area greater than the hole area of the nozzle assembly. As a result the reliability is increased, as the apparatus is self-adjusting with regard to the wear caused by the movement of the nozzle assembly. The apparatus is furthermore easily assembled.

13 Claims, 5 Drawing Figures

APPARATUS FOR CLEANING SURFACES

FIELD OF THE INVENTION

The present invention relates to an apparatus for cleaning surfaces by means of a jet of cleaning liquid and comprising a sluicing pipe with a housing provided with a tiltably arranged nozzle assembly adapted to perform oscillations by means of a moving means mounted in the housing, preferably a hydraulic motor driven by the cleaning liquid flowing to the nozzle assembly.

BACKGROUND OF THE INVENTION

It is known in apparatuses of the above kind to provide the housing with a rotating nozzle assembly, in which the nozzle rotation is produced by a moving means in the form of a hydraulic motor comprising a small turbine driven by the cleaning liquid flowing to the nozzle assembly. An apparatus of this type does not work completely satisfactorily, there being no compensation for the wear caused by the rotation of the nozzle assembly.

An apparatus is furthermore known, in which the nozzle assembly is tiltably mounted on an shaft projecting from the housing, and in which the tilting movement is produced by a hydraulic motor within the housing. In this case the wear occurs around the shaft seal between shaft and housing, while the nozzle assembly performs its tilting movement. The shaft seal will consequently be the weak point.

The known constructions have in common that they are not as reliable as required, as they are not self-compensating with regard to the wear caused by the movement of the nozzle assembly. They are furthermore not easily assembled.

SUMMARY OF THE INVENTION

The object of the present invention is to provide an apparatus of the above kind, in which these defects have been remedied.

The apparatus according to the invention is characterized in that the tiltable nozzle assembly is located within the housing and at its front end comprises a contact surface, by means of which it is capable of tilting on the bearing surface provided with a discharge opening, said bearing surface being located on a discharge member on the outlet of the housing, the discharge member having a central flow channel for the cleaning liquid, and said discharge opening having a sectional area greater than the hole area of the nozzle assembly. As a result the reliability is increased considerably, as the wear arising between the tiltable nozzle assembly and the discharge member will be compensated for by the nozzle assembly having its contact surface pressed in outward direction towards the bearing surface of the discharge member by means of the cleaning liquid under pressure; in spite of the wear cleaning liquid can thus never unintentionally leak out beside the nozzle assembly. As the apparatus is very simple, its parts are easily assembled. The tiltable nozzle is moreover in a simple manner moved by the hydraulic motor.

Furthermore, according to the invention the bearing surface of the discharge member may be situated on a bearing portion enclosed in said assembly, said bearing portion being made completely or partially of polyimide, polyphenylene sulfide, polyamide imide, polyether etherketone, polyether imide or polyether sulfones. As a result the bearing surface of the discharge member will be particularly wear-resistant.

The discharge member may furthermore according to the invention comprise a flow channel placed in continuation of the through channel of the nozzle assembly, said flow channel having a vertex angle preferably in the range of 10°-90°. The jet of cleaning liquid leaving the nozzle assembly during the tilting movement of the assembly can thus unobstructedly pass out through the discharge member.

Besides, the sectional area of the discharge opening of the bearing surface may be at least 1.5 times greater than the hole area of the nozzle assembly, thus ensuring that the nozzle assembly can unobstructedly get rid of this liquid jet in any position during its tilting movement.

A protecting funnel may according to the invention be mounted around and in front of the discharge member, the length of said funnel preferably being between 0 and 10 cm, and its conicity being substantially equal to the conicity of the channel in the discharge member. As a result the operator and other persons are prevented from getting too close to the jet of cleaning liquid during the operation of the apparatus.

Moreover according to the invention the discharge member may from the outside be screwed into a circular aperture forming the outlet of the housing, thus providing a very easy mounting of the discharge member.

An embodiment of the apparatus, in which the moving means is constituted by a rotor for the hydraulic motor, is according to the invention characterized in that the nozzle assembly is connected to the rotor by means of a crank or eccentric connection. As a result the nozzle assembly can perform its tilting movement in a very reliable manner.

The driving connection between the nozzle assembly and the rotor may according to the invention be constituted by an oblong moving ring mounted on the nozzle assembly, said moving ring being placed around an eccentric projection, optionally a pin, projecting from the rotor. This embodiment has proved particularly simple and efficient in operation.

The housing may according to the invention comprise an inlet channel for feeding liquid to the rotor, said inlet channel being substantially parallel to said flow channel. As a result the frictional loss in the liquid during the rotor passage will be reduced considerably.

Besides, according to the invention a portion of the through channel of the nozzle assembly may be substantially conical, and said channel may optionally immediately before the conical part comprise a liquid flow rectifier. The tendency of turbulence is consequently reduced, thus increasing the cleaning effect.

Finally according to the invention the radius of curvature of the contact surface may be smaller than the radius of curvature of the bearing surface.

BRIEF DESCRIPTION OF THE DRAWINGS

The invention will be described below with reference to the accompanying drawing, in which.

DETAILED DISCUSSION OF THE INVENTION

Figure 1:
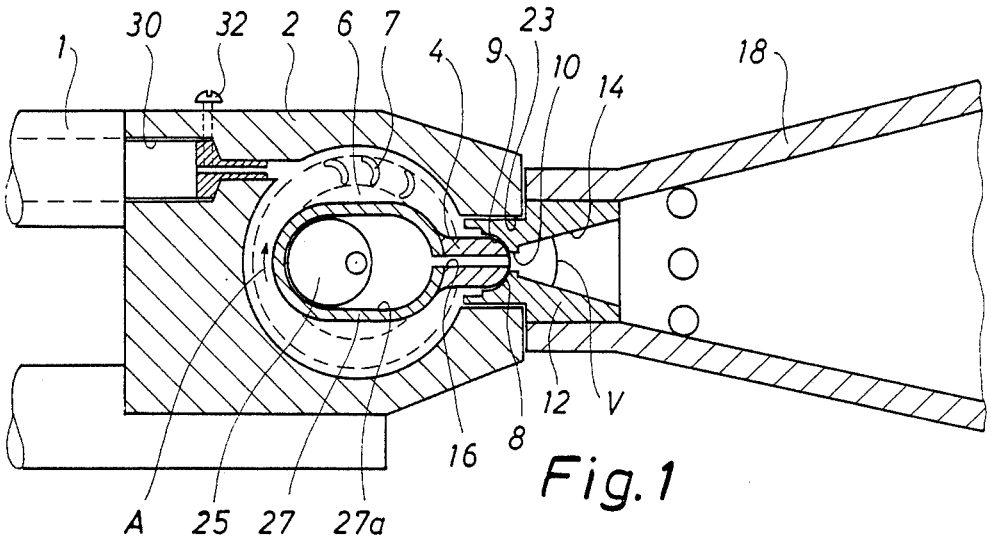
FIG. 1 is a longitudinal sectional view along the line I—I in FIG. 5 of an embodiment of the apparatus according to the invention clearly illustrating how the nozzle assembly is capable of tilting on the discharge member.

The apparatus illustrated in FIG. 1 comprises a sluicing pipe section 1 (only part thereof is illustrated), at the end of which a housing 2 is mounted for distributing the cleaning liquid flowing forward through the sluicing pipe section. A nozzle assembly 4 is tiltably arranged in the interior of the housing, said nozzle assembly being adapted to perform oscillations by means of a moving means 6 mounted in the housing. The latter may as illustrated consist of a hydraulic motor driven by the liquid flowing to the nozzle assembly. The moving means may, however, also be constructed in other ways.

The nozzle assembly 4 is as mentioned mounted inside the housing 2 and comprises at its front end a contact surface 8, by means of which it is capable of tilting on a bearing surface 9 provided with a discharge opening 10 and mounted on a discharge member 12. As illustrated the latter is located at the outlet of the housing 2. The discharge member comprises a central flow channel 14 for cleaning liquid, and the jet of cleaning liquid oscillates in said channel in accordance with the rocking movement of the nozzle assembly. The discharge opening 10 of the bearing surface 9 communicating with the flow channel 14 has a sectional area greater than the hole area of the nozzle assembly 4. The through channel of the nozzle assembly is provided with the reference number 16. When the apparatus is in operation the wear on the contact surface 8 and the bearing surface 9 will be compensated for by the pressure of the cleaning liquid in the interior of the housing 2 pressing the nozzle assembly 4 for close abutment with the bearing surface 9.

Figure 2:
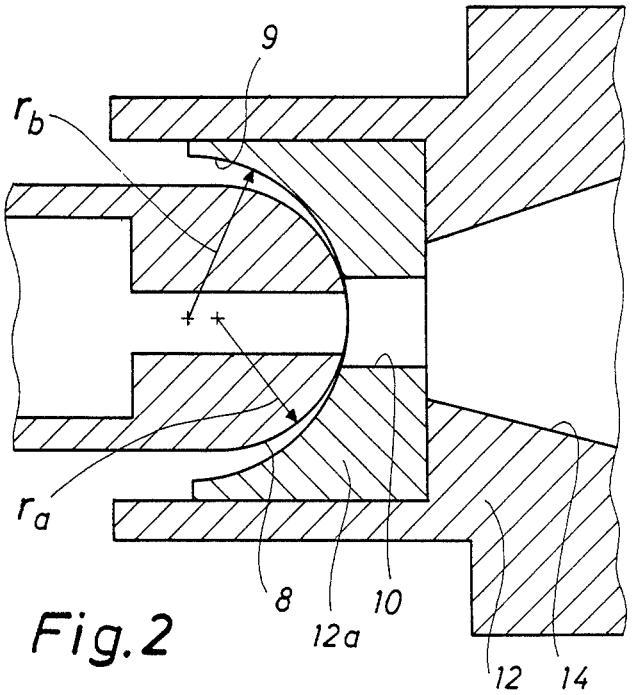
FIG. 2 is on a large scale a longitudinal sectional view of part of an embodiment of the apparatus, in which the discharge member is provided with a particular bearing surface-forming bearing portion, and it is illustrated that the radius of curvature of the contact surface of the nozzle assembly is smaller than that of said bearing surface.

As illustrated in FIG. 2 the bearing surface of the discharge member may be provided on a bearing portion 12*a* in said member, said bearing portion 12*a* being made of polyimide, polyphenylene sulfide, polyamide imide, polyether etherketone, polyether imide or polyether sulfones. The location of the bearing surface on a separate portion permits replacement of said bearing surface, if the wear becomes too great.

FIG. 1 furthermore illustrates how the flow channel 14 may be conical and be located in continuation of the through channel 16 of the nozzle assembly. The flow channel has a vertex angle preferably ranging from 10° to 90°.

A protecting funnel 18 may as illustrated in FIG. 1 be mounted around and in front of the discharge member 12, the length of said funnel preferably being 0–10 cm, and its conicity preferably being equal to the conicity of the channel 14 of the discharge member 12.

The discharge member 12 may be screwed into a circular aperture 23 forming the outlet of the housing, as the discharge member will then be threaded.

Figure 3:
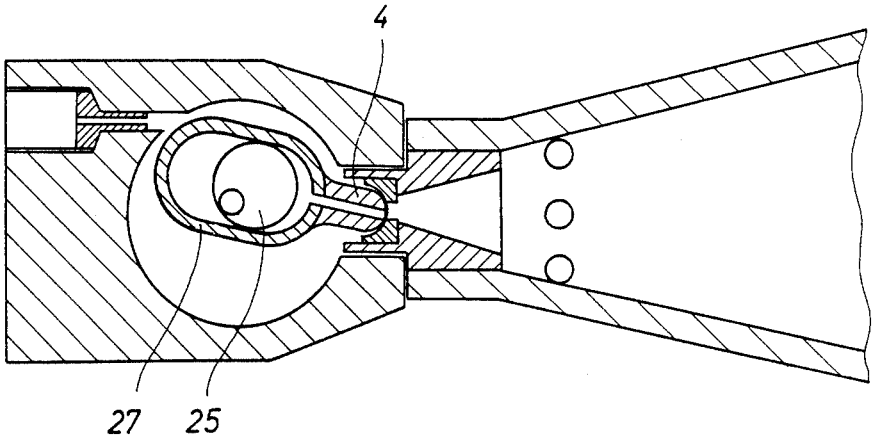
FIG. 3 illustrates the apparatus of FIG. 1, in which the nozzle assembly has been tilted into its extreme position.

FIG. 1 also illustrates how the rotor blades 7 of a hydraulic motor may be influenced by the flow of cleaning liquid from the pipe 1, so that the rotor is set into rotation; the rotational movement may be transferred to the nozzle assembly by means of a crank or eccentric connection. The rotor preferably comprises an eccentric projection, such as a pin 25, projecting into an oblong moving ring 27 mounted in the rear end of the nozzle assembly 4. When the the rotor is turned as illustrated by the arrow A in FIG. 1, the moving ring 27 will follow, cf. FIG. 3, in which the nozzle assembly has been tilted into one of its extreme positions. The inner cavity 27*a* of the moving ring is only partly filled out by the eccentric projection 25.

The inlet channel 30 illustrated in FIG. 1 for feeding liquid to the rotor 6 may be substantially parallel to the flow channel 14 of the discharge member 12, whereby the frictional loss in the liquid is reduced to some extent, as the liquid particles do not have to flow along a too tortuous path to leave the housing. The inlet channel may optionally contain an adjustable screw 32 for adjusting the flow of liquid to the rotor 6.

As indicated in FIG. 2 the discharge opening 20 of the bearing surface 9 may have a sectional area considerably greater than the hole area of the nozzle assembly 4, preferably at least 1.5 times the latter area, which particularly applies when the hole areas of the discharge opening 10 and the nozzle assembly 4 are circular.

Figure 4:
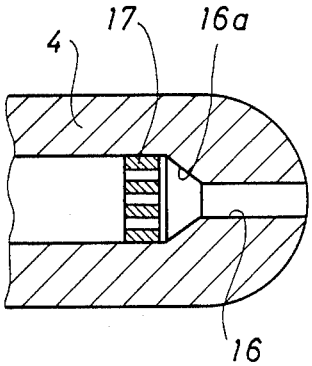
FIG. 4 illustrates an embodiment of the nozzle assembly, in which the through channel has a conical zone and in which a flow rectifier has been mounted in front of said zone.
Figure 5:
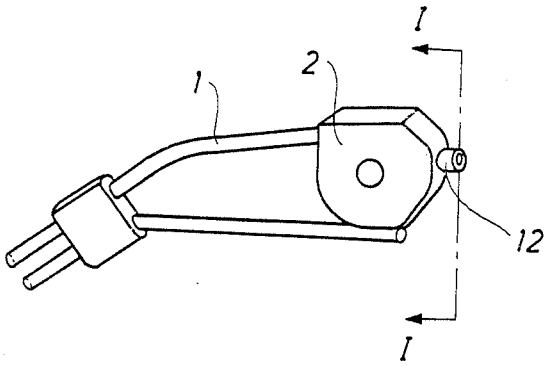
FIG. 5 is a perspective view of an embodiment of the apparatus.

FIG. 4 illustrates, how the through channel 16 of the nozzle assembly 4 may have a conical portion 16*a*. Immediately in front of the channel portion 16 (seen in the direction of the liquid flow) a so-called liquid flow rectifier may be mounted, by which is meant a sieve-like means of a certain thickness. Cleaning liquid passing through the rectifier will display a very small degree of turbulence.

FIG. 2 illustrates, how the radius of curvature $r_a$ may be smaller than the radius of curvature $r_b$ of the bearing surface 9.

The invention may be changed in many ways without thereby deviating from its idea.

We claim:

1. An apparatus for cleaning surfaces by means of a jet of cleaning liquid, the apparatus comprising a sluicing pipe (1) connected with a housing (2) provided with a tiltably arranged nozzle assembly (4) therein, the nozzle assembly (4) adapted to perform oscillations by means of a hydraulic motor (6) in the housing driven by the cleaning liquid prior to the cleaning liquid flowing to the nozzle assembly (4), the improvement characterized in that the tiltable nozzle assembly (4) has an oscillation coupling (27) integral therewith, is located within the housing (2) and has a front end including a contact surface (8) which bears against bearing surface (9) located downstream of the nozzle assembly (4) and provided with a discharge opening (10), the nozzle assembly (4) having an outlet (16) aligned with the discharge opening (10) and the nozzle assembly (4) being tiltable on the bearing surface (8); said bearing surface being located on a discharge member (12) at the outlet of the housing (2), the discharge member having a central flow channel (14) for the cleaning liquid, and said central flow channel (14) having a cross sectional area greater than the outlet (16) of the nozzle assembly (4).

2. An apparatus as in claim 1, characterized in that the bearing surface of the discharge member (12) is situated on a bearing portion (12*a*) enclosed in said assembly, said bearing portion being made of a resin selected from the group consisting of polyamide, polyphenylene sulfide, polyamide imide, polyether etherketone, polyether imide and polyether sulfones.

3. An apparatus as in claim 2, characterized in that the flow channel (14) of the discharge member (12) is conical and is placed in continuation of the through-channel (16) of the nozzle assembly (4), said flow channel having a vertex angle (v) preferably in the range of 10°–90°.

4. An apparatus as in claim 1, characterized in that the flow channel (14) of the discharge member (12) is conical and is placed in continuation of the outlet opening (16) of the nozzle assembly (4), said flow channel having a vertex angle (v) in the range of 10°–90°.

5. An apparatus as in claim 1, characterised in that the sectional area of the discharge opening (10) of the bearing surface (9) is at least 1.5 times greater than the hole area of the nozzle assembly (4).

6. An apparatus as in claim 1, characterized in that a protecting funnel (18) is mounted around and in front of the discharge member (12), the length of said funnel preferably being between 0 and 10 cm, and its conicity being substantially equal to the conicity of the channel (14) in the discharge member (12).

7. An apparatus as in claim 1, characterized in that the discharge member (12) from the outside is screwed into a circular aperture (23) forming the outlet of the housing (2).

8. An apparatus as in claim 1, and in which the moving means (6) is constituted by a rotor for a hydraulic motor, characterized in that the nozzle assembly (4) is connected to the rotor by means of an eccentric connection (25, 27).

9. An apparatus as in claim 8, characterized in that the driving connection between the nozzle assembly (4) and the rotor (6) is constituted by an oblong moving ring (27) mounted on the nozzle assembly (4), said moving ring being placed around an eccentric projection (25), optionally a pin, projecting from the rotor, the eccentric projection (25) only partially filling up the moving ring (27).

10. An apparatus as in claim 9, characterized in that the housing (2) comprises an inlet channel (30) for feeding liquid to the rotor, said inlet channel (30) being substantially parallel to said flow channel (14).

11. An apparatus as in claim 1, characterized in that a portion (16*a*) of the outlet opening (16) of the nozzle assembly (4) is substantially conical, and that said channel immediately before the conical part comprises a liquid flow rectifier (17).

12. An apparatus as in claim 1, characterized in that the radius of curvature ($r_a$) of the contact surface (8) is smaller than the radius of curvature ($r_b$) of the bearing surface (9).

13. An apparatus for cleaning surfaces by impinging a stream of liquid thereon, the apparatus comprising:

a housing with opposed inlet and outlet opening and a chamber therein communicating with the openings;

means for supplying pressurized liquid through the inlet opening and into the chamber;

a nozzle floating in the housing, the nozzle being disposed between the inlet and outlet openings and including a front end with a rounded abutment surface, the front end having a discharge opening therethrough; the nozzle further including a drive coupling integral therewith and in rigid association therewith;

means in said housing operated by fluid pressure from the inlet and connected to the drive coupling of the nozzle for oscillating the nozzle;

a rounded concave bearing surface inside of the housing aligned with the outlet opening of the housing and facing the inlet opening of the housing; the rounded abutment of the nozzle engaging the bearing surface and being urged thereagainst by the fluid pressure applied through the inlet opening in the housing, and the bearing surface having an opening therethrough in communication with the discharge opening in the front end of the nozzle; whereby liquid in the housing is dispensed in oscillating fashion through the aligned openings while the nozzle pivots on the concave bearing surface.

* * * * *